United States Patent [19]

Sayles

[11] 3,997,455

[45] Dec. 14, 1976

[54] PARAFFINIC BASE GREASES

[75] Inventor: Francis S. Sayles, Rocky Hill, N.J.

[73] Assignee: Mobil Oil Corporation, New York, N.Y.

[22] Filed: June 26, 1975

[21] Appl. No.: 590,760

Related U.S. Application Data

[63] Continuation-in-part of Ser. No. 484,909, July 1, 1974, Pat. No. 3,904,534.

[52] U.S. Cl. ..... 252/36; 252/37; 252/40.5; 252/56 R

[51] Int. Cl.[2] ..... C10M 5/16; C10M 5/28

[58] Field of Search ..... 252/36, 56 R, 40.5, 252/51.5 A, 51.5 R

[56] References Cited

UNITED STATES PATENTS 3,705,853 12/1972 Fau et al. ..... 252/36

*Primary Examiner*—Delbert E. Gantz
*Assistant Examiner*—Irving Vaughn
*Attorney, Agent, or Firm*—Charles A. Huggett; Malcolm Keen

[57] ABSTRACT

Greases containing a calcium or calcium/lead complex thickener, a terpolymer improver and a paraffinic base lubricating vehicle. The greases have a thicker consistency than is normally obtained with paraffinic base stocks. They are produced by introducing the terpolymer to the charge of the lubricating vehicle and thickening agent components prior to saponification.

26 Claims, No Drawings

PARAFFINIC BASE GREASES

CROSS REFERENCE TO RELATED APPLICATIONS

This application is a continuation-in-part of my copending application Ser. No. 484,909, filed July 1, 1974 now U.S. Pat. No. 3,904,534.

BACKGROUND OF THE INVENTION

1. Field of the Invention.

This invention relates to greases and more particularly, to greases which contain a calcium or calcium/-lead complex thickener.

2. Description of the Prior Art

Calcium soaps have been used for a long time as grease thickeners. For example, J. I. Clower referred to the use of lime base greases in "Lubricants and Lubrication", First Edition, McGraw-Hill, New York 1939, page 68 et seq. The soaps are produced by the saponification of fatty materials (naturally occurring triglyceride esters or the fatty acids derived from the glycerides) with lime, as is conventional in the art. The use of various complex soap thickeners such as the mixed calcium salts and soaps is also known. For example, Boner in "Manufacture and Application of Lubricating Greases", Krieger, 1971 (reprint of 1954 edition), Chapter 16 refers extensively to such complex soap thickeners and Liddy U.S. Pat. No. 2,999,065 discloses the use of calcium complex thickeners derived from low, intermediate and high molecular weight acids. Schott U.S. Pat. No. 2,898,297 describes a calcium complex thickener which includes calcium soaps derived from nut oil acids.

The lubricating vehicle base stocks which have been used with these thickeners have been naphthenic in nature. That is, the hydrocarbons in the base stock have been predominantly alicyclic rather than straight chain. These base stocks have been preferred because they give a firm-bodied grease whereas paraffinic base stocks yield soft-bodied greases with the same amount of a given soap thickener. Thus, the naphthenic base stocks give a better yield of grease in relation to the amount of thickener. Although it would be possible to use a greater amount of thickener to produce a grease of given consistency using a paraffinic base stock, the high cost of soap relative to that of the oil has generally made this uneconomical. In addition the amount of soap necessary to produce a thick bodied base with a paraffinic base, e.g. NLGI Grade 3, can lead to an unstable grease structure. Such a grease might soften during use (as a result of which it might run out of the bearings in which it was being used).

U.S. Pat. No. 3,705,853 to Fau describes the use of certain ethylene terpolymers as improvers in calcium and calcium/lead thickened greases.

SUMMARY OF THE INVENTION

I have now discovered that firm bodied greases can be made economically from paraffinic base stocks. The thickeners used in these greases may be calcium complex or calcium/lead complex thickeners, although the former are preferred. In addition to the lubricating vehicle base and the complex thickener the greases contain a terpolymer improver and any other additive desired, e.g. rust inhibitors, extreme-pressure agents and antioxidants.

According to the present invention I therefore provide a grease composition comprising (i) a predominantly paraffinic lubricating vehicle, (ii) a thickener comprising a calcium or calcium/lead complex and (iii) an organic terpolymer improver.

DESCRIPTION OF SPECIFIC EMBODIMENTS

As stated above, the grease has three essential components, namely, the paraffinic lubricating vehicle, the thickener and the terpolymer. These will be discussed separately below.

LUBRICATING VEHICLE

This is predominantly a paraffinic lubricating stock. At least 30%, generally at least 50% and preferably at least 80% by weight is a paraffinic lubricating oil. The balance of the lubricating vehicle may be a naphthenic lubricant but since these stocks are more expensive than paraffinic stocks, their use is economically unfavorable particularly since the present invention enables the greases to be produced wholly from the paraffinic stocks, i.e. the lubricant vehicle is entirely a paraffinic stock. If their use is desired for any particular purposes, asphaltic stocks may be used in combination with the paraffinic. As will be explained below, however, it is desirable to use the paraffinic stock during the saponifications and to add the other stocks later.

If desired, non-mineral oil lubricating vehicles may be blended with the paraffinic oil. This may be desirable if particular properties are desired in the final grease. Suitable synthetic lubricating vehicles which may be included are, for example, synthetic ester lubricants, e.g. the dibasic acid esters such as di-ethylhexyl azelate or sebacate, the hindered polyol esters such as the neopentyl glycol esters, e.g. the trimethylol propane and pentaerythritol esters of $C_6$ to $C_{10}$ monocarboxylic acids; synthetic hydrocarbons such as the hydrogenated olefin polymers described in U.S. Pat. No. 3,149,178 to Lyle A. Hamilton et al. Mixtures of three or more lubricating vehicles may also be used, although the paraffinic mineral oil should normally comprise at least 50% by weight of the lubricating vehicle in the grease.

The paraffinic stocks used in the greases will generally have a viscosity of from 40 to 10,000 SUS at 100° F., preferably 60 to 6000 SUS at 100° F. (4 to 2000 cS at 38° C, preferably 10 to 1200 cS at 38° C). If a minor amount of a naphthenic mineral oil is blended with the paraffinic, it too will generally have a viscosity in this range. In both cases, viscosity indexes from 30 to 100 are preferred.

The paraffinic base stocks will normally be acid-treated, solvent-refined or hydrofinished paraffinic oils. The various treatments to which the oils may be subjected are intended to remove the less paraffinic constituents and, by so doing, to raise the viscosity index. For example, solvent-refining removes the less paraffinic constituents and hydrofinishing converts the non-paraffinics to paraffinics; acid reacts with the non-paraffinics and enables them to be removed.

THICKENING AGENT

Both calcium complex and calcium/lead complex thickeners may be used, although the former are preferred. Both types of thickener are derived from a mixture of acids and the thickeners are conveniently characterized by a description of the acids used to form the salt/soap mixtures. Since these complex thickeners invariably contain acetate salts, they are often referred to as calcium and calcium/lead acetate complex thickeners.

The acids preferably comprise a complex mixture of low, intermediate and high molecular weight carboxylic acids. The molecular weights (carbon atom content) of the acids and the proportions in which they are used are as follows:

| Acid | No. of atoms | Wt. Percent of total acids | |
|---|---|---|---|
| | | Broad | Preferred |
| Low Mol. Wt. | 1–6 | 10–60 | 20–45 |
| Inter. Mol. Wt. | 7–12 | 10–80 | 25–50 |
| High Mol. Wt. | 13 or more | 2–75 | 15–50 |

Acetic acid is the preferred low molecular weight carboxylic acid and caprylic is a preferred intermediate weight carboxylic acid. As it has an even number of atoms it is conveniently available from natural sources. Naturally occurring oils are convenient sources for the high molecular weight carboxylic acids (normally $C_{13}$–$C_{36}$ although higher molecular weight materials may be present). Coconut oil is a convenient source of $C_{12}$–$C_{15}$ acids and tallow a convenient source of $C_{18}$ acids. Hydrogenated tallow ($C_{18}$) acids are preferred. Candellila wax is a source of higher ($C_{20}$+) acids.

Preferred complex acid mixtures of this type are as follows (weight percent of total acids):

| | Broad | Preferred |
|---|---|---|
| Acetic Acid | 20–30 | 25 |
| Caprylic Acid | 15–20 | 17 |
| Coconut oil acids | 40–45 | 43 |
| Tallow acids | 10–20 | 15 |

The tallow acids are preferably hydrogenated to reduce residual unsaturation.

Another preferred type of calcium or calcium/lead complex salt/soap mixture is that which is derived from a number of high molecular weight carboxylic acids and also has a low molecular weight carboxylic acid. Preferably a saturated and an unsaturated acid are present in order to obtain satisfactory consistency in the grease. Such mixtures are made up as follows (weight percent):

| | Broad | Preferred |
|---|---|---|
| High molecular wt. acids ($C_{13+}$) | 70–90 | 80–90 |
| Low molecular wt. acids ($C_1$–$C_6$) | 10–30 | 10–20 |

The high molecular weight acids are preferably a blend of $C_{18}$ unsaturated carboxylic acids, e.g. oleic acid, $C_{18}$ saturated carboxylic acids, e.g. hydrogenated tallow acids and higher ($C_{20+}$) carboxylic acids. The preferred low molecular weight acid is acetic acid. The preferred ranges for the high molecular weight acids are as follows (weight percent of total acids):

| | Broad | Preferred |
|---|---|---|
| Unsaturated $C_{18}$ acids | 30–40 | 30–40 |
| Saturated $C_{18}$ acids | 30–90 | 30–50 |
| $C_{20+}$ Acids | 10–30 | 10–20 |

Another type of complex thickener is that based on a mixture of low and intermediate molecular weight acids, for example, a mixture of acetic acid with capric or caprylic acid. In these complexes, the ratio of low molecular weight acid to intermediate molecular weight acid is preferably from 0.25:1 to 10:1.

The acids are converted to their respective salts and soaps by reaction with lime (in the case of calcium thickened greases) or lime/litharge (PbO) (in the case of calcium/lead thickened greases). The ratio of lime to litharge for the mixed base greases is preferably at least 5:1 (CaO:PbO) more preferably at least 10:1.

Calcium complex and calcium/lead complex thickeners of these types are described in U.S. Pat. Nos. 3,170,878, 2,999,065, 2,197,263, 2,898,297 and 2,878,187, the disclosures of which are incorporated herein by reference.

TERPOLYMER

The terpolymers used in the present greases are described fully in U.S. Pat. No. 3,705,853 to Fau, the disclosure of which is incorporated by reference. That is, the terpolymers have a melt index of 0.5 to 200 and contain:

1. at least 65%, by weight, of ethylene, (2) at least 5%, by weight, of a second ethylenically unsaturated monomer which is an ester of the group consisting of the vinyl esters of the lower (1–6 carbon) saturated aliphatic carboxylic acids, the alkyl acrylates, the alkyl methacrylates, the dialkyl maleates and the dialkyl fumarates of the lower (1–6 carbon) aliphatic alcohols; and (3) 0.01 to 3%, by weight, of a third ethylenically unsaturated monomer of the group consisting of acrylic, methacrylic, itaconic, maleic and fumaric acids; the anhydrides of itaconic, maleic and fumaric acids; the alkyl hydrogen maleates and the alkyl hydrogen fumarates; the monoacrylates and monomethacrylates of glycols; 2-hydroxy-3-amino-propyl allyl ether, allyl glycerol ether, divinyl glycol, 2-dimethylaminoethyl acrylate, 2-dimethylaminoethyl methacrylate and N-vinyl pyrrolidone.

The preparation of these terpolymer improving agents is described in U.S. Pat. No. 3,215,657, issued Nov. 2, 1965.

The preferred terpolymers contain from about 20 to about 30%, by weight, of the group (2) component, i.e. the second ethylenically unsaturated monomer component; and from about 0.1 to about 1%, by weight, of the group (3) component, i.e. the third ethylenically unsaturated monomer component. Representative preferred terpolymers comprise, in addition to ethylene, from about 20 to about 30%, by weight, vinyl acetate and from about 0.1 to about 1%, by weight, acrylic acid; from about 20 to about 30%, by weight, vinyl acetate and from about 0.1 to about 1%, by weight, methacrylic acid; from about 20 to about 30%, by weight, ethyl acrylate and from about 0.1 to about 1%, by weight, acrylic acid; from about 20 to about 30%, by weight, ethyl acrylate and from about 0.1 to about 1%, by weight methacrylic acid; from about 20 to about 30%, by weight, methyl methacrylate, and from about 0.1 to about 1%, by weight, acrylic acid; and from about 20 to about 30%, by weight, methyl methacrylate and from about 0.1 to about 1%, by weight, methacrylic acid.

The most preferred terpolymers comprise (i) at least 65 wt. percent of ethylene, (ii) 20–30 wt. percent of vinyl acetate and (iii) 0.01 to 3 wt. percent of an unsaturated acid or anhydride, preferably methacrylic acid. A particularly preferred terpolymer comprises 71.8 wt. percent ethylene, 25 wt. percent vinyl acetate and about 0.71 wt. percent methacrylic acid.

The terpolymer is essential to produce the desired consistency and stability in the finished grease. In addition, it also improves the water wash-out resistance and the resistance to softening at high temperatures. The greases of the present invention are therefore characterized by having a heavier consistency than they would have in the absence of the terpolymer (if the grease is otherwise identical).

PROPORTIONS

The proportion of thickener relative to the oil depends, of course, on the consistency required in the finished grease. Although experience in the past indicated that predominantly paraffin base stocks produced greases which were not as firm as those produced from naphthenic base stock, I have found that paraffinic stocks produce a grease which is just as firm as that produced from naphthenic stocks with the same amount of a given thickener. Thus, the greases are characterized by a content of predominantly paraffinic lubricating oil which is not substantially less than that of a naphthenic base oil required in a grease of substantially the same consistency.

The amount of thickener will, as stated above, be determined by the grade (firmness) of the grease. Consistency is normally measured by the ASTM D 217-68 Test (Cone Penetration of Lubricating Grease).

The National Lubricating Grease Institute has classified greases according to their consistency as measured by the worked penetration. Penetration values for the NLGI grades are as follows:

| NLGI Grade | ASTM D 217-68 (worked, 60 strokes) |
|---|---|
| 3 | 220–250 |
| 2 | 265–295 |
| 1 | 310–340 |
| 0 | 355–385 |
| 00 | 400–430 |
| 000 | 445–475 |

For semi fluid Grades 00 and 000, as well as softer products not in the NLGI classification, the Brookfield viscosimeter is sometimes used to determine consistency.

These classifications are arbitrary; it is, of course, possible to produce greases with consistencies intermediate the ranges listed.

The amount of thickener needed in a grease may be calculated by reference to the amount of saponifiable fatty material. This is used as the basis for all such calculations in this specification.

The approximate amounts of thickener used for greases of various consistencies are shown in Table 1 below.

Table 1

| | | | Thickener Content, wt.% Fatty Material | | |
|---|---|---|---|---|---|
| NLGI Grade | Worked Consistency | Broad | Preferred (1) | Preferred (2) | Nominal |
| 3 | 220–250 | 10–15 | 11–14 | 12–13 | 12 |
| 2 | 265–295 | 8–13 | 9–12 | 10–11 | 10 |
| 1 | 310–340 | 4–9 | 5–8 | 6–7 | 6 |
| 0 | 355–385 | 3–8 | 4–7 | 5–6 | 5 |
| 00 | 400–430 | 2–7 | 3–6 | 4–5 | 4 |
| 000 | 445–475 | 1.5–6 | 2–5.5 | 3.5–4.5 | 3.5 |

The figures given in Table 1 above are for a homogenized grease with a calcium complex thickener derived from a mixture of low, intermediate and high molecular weight fatty acids (approximately 25% acetic acid, 18% caprylic acid, 14% high molecular weight acids, 42% coconut oil acids).

If the grease is not homogenized (as in the case with long fiber textured greases) greater contents of thickener may be desired. For example, an NLGI Grade 0 grease of this type would contain approximately 7 to 15% thickener and a No. 1 Grade approximately 10 to 20%. The figures given above are with reference to the NLGI grades. As previously mentioned, it is possible, of course, to produce greases of any desired consistency by varying the amount of thickener in the appropriate manner. For example a grease of the type referred to in Table 1 could have a penetration figure of 240–270 at a nominal thickener content of 11%.

The consistency will also vary with the exact type of complex thickener used since each different complex thickener system will vary in its thickening power.

The amount of the terpolymer is from 0.01 to 10 wt. percent, usually 0.1 to 5%. The additives will be present in their normal amounts.

PREPARATION

The greases are prepared by the method described in my co-pending patent application Ser. No. 484,909. That is, the terpolymer is introduced into the charge of lubricating vehicle and thickening agent components prior to saponification. In a typical procedure, the fatty materials which are to form the thickener are charged to a contactor together with the terpolymer, lime (or lime and litharge), water and oil. The charge in the contactor is then heated to saponify the fatty material and so form the complex thickener. The grease is then partly dehydrated. After saponification has proceeded to the desired extent, the partly dehydrated charge is transferred to the finishing kettle where the dehydration is completed. Cooling, addition of various additives, homogenization and final additions of lubricating vehicle complete the procedure.

If a second type of lubricating vehicle is used (in addition to the paraffinic mineral oil stock), it is added to the grease after dehydration. The paraffinic stock is always present in the charge to the contactor because the effect of the terpolymer on the grease is much more marked when the paraffinic stock is added at this stage. Thus, if a mixed paraffinic/asphaltic grease is to be prepared, the saponification will be carried out with the paraffinic base stock and the asphaltic lubricating stock will be added after dehydration, when the grease is brought to its final desired consistency. The viscosity of the paraffinic base stock which is in the charge to the contactor will be in the range of 40 to 2000 SUS at 100° F, generally in the range of 60 to 1,000 SUS at 100° F (4 to 420 cS at 38° C, generally 10 to 220 cS at 38° C).

The greases produced in this way are heavier in consistency than the greases produced by adding the terpolymer to the finishing kettle with an otherwise identical grease.

The additives which may be present in the greases may be added at temperature stages which will depend on the nature of the additive. Suitable additives include rush inhibitors such as sodium nitrite, antioxidants such as alkylated phenolics, aromatic amines such as p,p'-dioctyldiphenylamine and extreme pressure agents such as chlorinated hydrocarbons. Coloring materials may also be used, if desired.

EXAMPLES

The following Examples are given by way of illustration only. The grease-making technique employed in the Examples below involves charging a contactor with appropriate amounts of fatty saponifiable material, lime, litharge, water and base oil. After saponification, the soap base is partially dehydrated and then discharged to a finishing kettle. In some Examples the terpolymer was added at this point whereas in other Examples it constituted a part of the original charge to the contactor. In the former cases dehydration of the soap base is concurrent with dispersion of the terpolymer. Cooling, addition of various additives, homogenization and final addition of oil, complete the manufacture.

The terpolymer employed in the Examples had a melt index of about 6 and contained about 71.8%, by weight, ethylene, about 25%, by weight, vinyl acetate and about 0.71%, by weight, methacrylic acid. The amount of terpolymer was approximately 0.5 wt. % of the total grease.

The base oils employed in Examples 1 to 6 were either a 500 SUS (100 cS) solvent-refined naphthenic neutral oil, with a V.I. of 60 or 300 SUS (70 cS) solvent-refined paraffinic neutral oil having a V.I. of 90. The base oils employed in Examples 7–12 were either a 900 SUS (200 cS) solvent-refined naphthenic neutral oil having a V.I. of 65 or a 300 SUS (70 cS) solvent paraffinic neutral oil having a V.I. of 90.

The thickener was either a calcium or calcium/lead acetate complex derived from a mixture of low, intermediate and high molecular weight fatty acids of the type referred to in Table 1 above. The amount of thickener used is shown with reference to the amount of saponifiable fatty material.

The results are shown in Tables 2 and 3 below.

Table 2

INFLUENCE OF TERPOLYMER AND BASE OIL ON CALCIUM-LEAD AND CALCIUM COMPLEX GREASES

| | | | Calcium-lead Complex Greases | | |
|---|---|---|---|---|---|
| Example | Terpolymer Present | Added To | Fatty Material % | Base Oil Type | Consistency UW/W (1) |
| 1 | No | | 12.0 | Naphthenic | 319/328 |
| 2 | Yes | Finishing Kettle | 12.0 | Naphthenic | 267/298 |
| 3 | Yes | Contactor Charge | 10.5 | Naphthenic | 280/301 |
| 4 | No | | 15.0 | Paraffinic | 365/378 |
| 5 | Yes | Finishing Kettle | 15.0 | Paraffinic | 347/361 |
| 6 | Yes | Contactor Charge | 11.0 | Paraffinic | 277/295 |

(1) Stroke Worked, ASTM Test D-217-68.

Table 3

| | | | Calcium Complex Greases | | |
|---|---|---|---|---|---|
| 7 | No | | 13.3 | Naphthenic | 270/320 |
| 8 | Yes | Finishing Kettle | 13.3 | Naphthenic | 250/297 |
| 9 | Yes | Contactor Charge | 13.3 | Naphthenic | 210/235 |
| 10 | No | | 13.3 | Paraffinic | 277/313 |
| 11 | Yes | Finishing Kettle | 14.0 | Paraffinic | 268/320 |
| 12 | Yes | Contactor Charge | 10.5 | Paraffinic | 251/276 |

As will be apparent from Tables 2 and 3, higher amounts of fatty material or softer consistency results are encountered in the finished grease where the terpolymer is either absent, or introduced into the finished grease contrasted with the presence of smaller amounts of fatty material or firmer consistency results when the terpolymer is introduced in the charge to the contactor.

The effect of the terpolymer improver as investigated further by preparing two greases of similar consistencies, one with terpolymer and the other without. A solvent-refined paraffinic base stock of 300 SUS at 100° F (70 cS at 38° C) viscosity and 90 V.I. was used. The finished grease was tested in the extended working test (ASTM D 217-68, 10,000 strokes) and the High Temperature Churn Test both with and without water. The High Temperature Churn Test is a modified RIV Test, a simulated rotating ball bearing test. The RIV Test is described in NLGI Spokesman, April 1955, pp. 38–43. This test is modified by operation at a higher temperature, 93° C, at 300 rpm. The test apparatus is modified by the use of a heavier head to retain the water which is mixed with the grease in the bowl during the part of the test in which water is added.

The results are shown in Table 4 below.

Table 4

| Example No. | 13 | 14 |
|---|---|---|
| Polymer amount, wt.% | 0.5 | None |
| Fatty material, wt.% | 14.0 | & 15.7 |
| Penetration, worked 60× | 204 | 212 |
| Penetration change after 10,000×, % | 60 | 78 |
| Penetration change after Churn Test at 93° C, % | 10 | 112 |
| Penetration change after Churn Test with water at 93° C, % | 114 | 132 |

These results show that the yield is better and that the grease has better work stability, as shown by the Extended Working Test and the High Temperature Churn Test, and that it also has better stability in the presence of water at higher temperatures.

The invention has been described with reference to specific working embodiments. It is not limited to those embodiments.

I claim:

1. A lubricating grease comprising (i) a predominantly paraffinic lubricating vehicle, (ii) a thickener comprising a calcium or calcium/lead complex soap and (iii) an organic terpolymer improver which comprises (1) at least 65%, by weight, of ethylene, (2) at least 5%, by weight, of a second ethylenically unsaturated monomer which is an ester of the group consisting of: the vinyl esters of saturated aliphatic carboxylic acids having 1–6 carbons; the alkyl acrylates, the alkyl methacrylates, the dialkyl maleates and the dialkyl fumarates of aliphatic alcohols having 1–6 carbons; and (3) 0.01 to 3%, by weight of a third ethylenically unsaturated monomer of the group consisting of: acrylic, methacrylic, itaconic, maleic, and fumaric acids; the anhydrides of itaconic, maleic and fumaric acids; the alkyl hydrogen maleates and the alkyl hydrogen fumarates; the monoacrylates and monomethacrylates of glycols; 2-hydroxy-3-aminopropyl allyl ether, allyl glycerol ether, divinyl glycol, 2-dimethylaminomethyl acrylate, 2-dimethylaminoethyl methacrylate and N-vinyl pyrrolidone.

2. A grease according to claim 1 in which the grease is prepared by adding the terpolymer to the contactor charge prior to saponification.

3. A grease according to claim 1 in which the terpolymer comprises (i) at least 65 wt. percent of ethylene (ii) 20–30 wt. percent of vinyl acetate and (iii) 0.01 to 3 weight percent of an unsaturated acid or anhydride.

4. A grease according to claim 3 in which the unsaturated acid comprises methacrylic acid.

5. A grease according to claim 4 in which the terpolymer comprises about 71.8 wt. percent ethylene, about 25 wt. percent vinyl acetate and about 0.71 wt. percent methacrylic acid.

6. A grease according to claim 1 in which the thickener comprises a complex soap derived from a mixture of low, intermediate and high molecular weight carboxylic acids as follows:

| Acid | Wt. percent |
|---|---|
| Low molecular wt. ($C_1$–$C_6$) | 10–60 |
| Intermediate molecular wt. ($C_7$–$C_{12}$) | 10–80 |
| High molecular wt. ($C_{13}$ or more) | 2–75 |

7. A grease according to claim 6 in which the thickener is derived from a mixture of carboxylic acids as follows:

| Acid | Wt. percent |
|---|---|
| Low molecular wt. ($C_1$–$C_6$) | 20–45 |
| Intermediate molecular wt. ($C_7$–$C_{12}$) | 25–50 |
| High molecular wt. ($C_{13}$ or more) | 15–50 |

8. A grease according to claim 6 in which the thickener is derived from a mixture of acetic acid, caprylic acid, coconut oil acids and tallow acids, as follows:

| Acid | Wt. percent |
|---|---|
| Acetic acid | 20–30 |
| Caprylic acid | 15–20 |
| Coconut oil acids | 40–50 |
| Tallow acids | 10–20 |

9. A grease according to claim 1 in which the thickener comprises a complex soap derived from a mixture of 70 to 90 wt. percent high molecular weight ($C_{13+}$) carboxylic acids and 10 to 30 wt. percent low molecular weight ($C_1$–$C_6$) carboxylic acids, the high molecular weight carboxylic acids comprising a mixture of saturated $C_{18}$ carboxylic acid, unsaturated $C_{18}$ carboxylic acid and higher molecular weight carboxylic acids.

10. A grease according to claim 1 in which the thickener comprises a calcium complex soap thickener.

11. A grease according to claim 1 in which the thickener comprises a calcium/lead complex soap thickener in which the ratio of calcium to lead is at least 5:1.

12. A grease according to claim 1 which has a worked penetration of from 220 to 250 by ASTM Test D 217-68 and has a thickener content of 10 to 15%, based on the weight of saponifiable fatty material.

13. A grease according to claim 12 in which the thickener content is 11 to 14%, based on the weight of saponifiable fatty material.

14. A grease according to claim 13 in which the thickener content is 12 to 13%, based on the weight of saponifiable fatty material.

15. A grease according to claim 1 which has a worked penetration of from 265 to 295 by ASTM Test D 217-68 and has a thickener content of 8 to 13%, based on the weight of saponifiable fatty material.

16. A grease according to claim 15 in which the thickener content is 9 to 12%, based on the weight of saponifiable fatty material.

17. A grease according to claim 16 in which the thickener content is 10 to 11%, based on the weight of the saponifiable fatty material.

18. A grease according to claim 1 which has a worked penetration of from 310 to 340 by ASTM Test D 217-68 and has a thickener content of 4 to 9%, based on the weight of saponifiable fatty material.

19. A grease according to claim 18 in which the thickener content is 5 to 8%, based on the weight of saponifiable fatty material.

20. A grease according to claim 19 in which the thickener content is 6 to 7%, based on the weight of saponifiable fatty material..

21. A grease according to claim 1 which has a worked penetration of from 355 to 385 by ASTM Test D 217-68 and has a thickener content of 3 to 8%, based on the weight of saponifiable fatty material.

22. A grease according to claim 21 in which the thickener content is 4 to 7%, based on the weight of saponifiable fatty material.

23. A grease according to claim 22 in which the thickener content is 5 to 6%, based on the weight of saponifiable fatty material.

24. A grease according to claim 1 which has a worked penetration of 400 to 430 by ASTM Test D 217-68 and has a thickener content of 3 to 6% based on the weight of saponifiable fatty material.

25. A grease according to claim 1 which has a worked penetration of 445 to 475 by ASTM Test D 217-68 and has a thickener content of 2 to 5.5%, based on the weight of saponifiable fatty material.

26. A grease according to claim 1 which has a consistency greater than that of an identical grease without the terpolymer improver.

* * * * *

UNITED STATES PATENT AND TRADEMARK OFFICE

CERTIFICATE OF CORRECTION

PATENT NO. : 3,997,455
DATED : December 14, 1976
INVENTOR(S) : FRANCIS S. SAYLES It is certified that error appears in the above-identified patent and that said Letters Patent are hereby corrected as shown below:

| | | |
|---|---|---|
| Column 3, line 19 | : | After "of" insert --carbon-- |
| Column 3, lines 33-36 | : | Under "Preferred" before "25", "17", "43" and "15" insert -- ≃ -- |
| Column 8, line 29 | | (Footnote to Table 2) - "(1) Stroke Worked, ASTM Test D-217-68" should be --(1) UW/W = Unworked/60 Stroke Worked, ASTM Test D-217-68.-- |
| Column 9, line 4 | | Under "14" line 2, before "15.7" delete --&-- |

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*